United States Patent [19]

Page et al.

[11] 4,237,843

[45] Dec. 9, 1980

[54] STARTING AID FOR A COMBUSTION ENGINE

[75] Inventors: Kenneth Page, Birmingham; David C. Bowie, Stratford on Avon; Alfred J. Taylor, Solihull; Richard P. Knowles, Farnborough, all of England

[73] Assignee: Lucas Industries Limited, Birmingham, England

[21] Appl. No.: 77,376

[22] Filed: Sep. 20, 1979

[30] Foreign Application Priority Data

Oct. 3, 1978 [GB] United Kingdom ..... 39024/78
May 2, 1979 [GB] United Kingdom ..... 15340/79

[51] Int. Cl.[3] ..... F02P 19/02; H05B 3/00

[52] U.S. Cl. ..... 123/145 A; 123/179 H; 219/270

[58] Field of Search ..... 123/145 A, 179 BG, 179 B, 123/179 H; 219/260, 270, 275

[56] References Cited

U.S. PATENT DOCUMENTS

| | | | |
|---|---|---|---|
| 1,359,514 | 11/1920 | Lightfoot | 123/145 A |
| 3,749,980 | 7/1973 | Baxter | 123/145 A |
| 4,087,904 | 5/1978 | Steinke et al. | 123/179 H |
| 4,107,510 | 8/1978 | Tombs et al. | 219/270 |

*Primary Examiner*—Charles J. Myhre
*Assistant Examiner*—Raymond A. Nelli

[57] ABSTRACT

A starting aid for a combustion engine comprises a hollow elongated body and a refractory electrical heating element mounted in the body at one end thereof. Formed in said one end of the body are one or more holes through which, in use, the heating element can be exposed to the combustion mixture of an engine. In addition, the body is formed with at least one exhaust aperture which is spaced from the heating element in the direction of the other end of the body and which permits the escape of gases entering the body through said one or more holes. Extending through the body and electrically connected to the heating element is an electrode rod for supplying heating current to the heating element to raise its temperature. The electrode rod includes two relatively movable parts which are mechanically connected by resilient means to maintain the heating element in compression against said one end of the body and which are electrically connected by a flexible braid. A heat resistant, gas restricting packing layer is mounted between the body and the electrode rod intermediate the ends of the body to allow free axial movement between the electrode rod and the body and substantially prevent gas flow past the packing layer.

18 Claims, 1 Drawing Figure

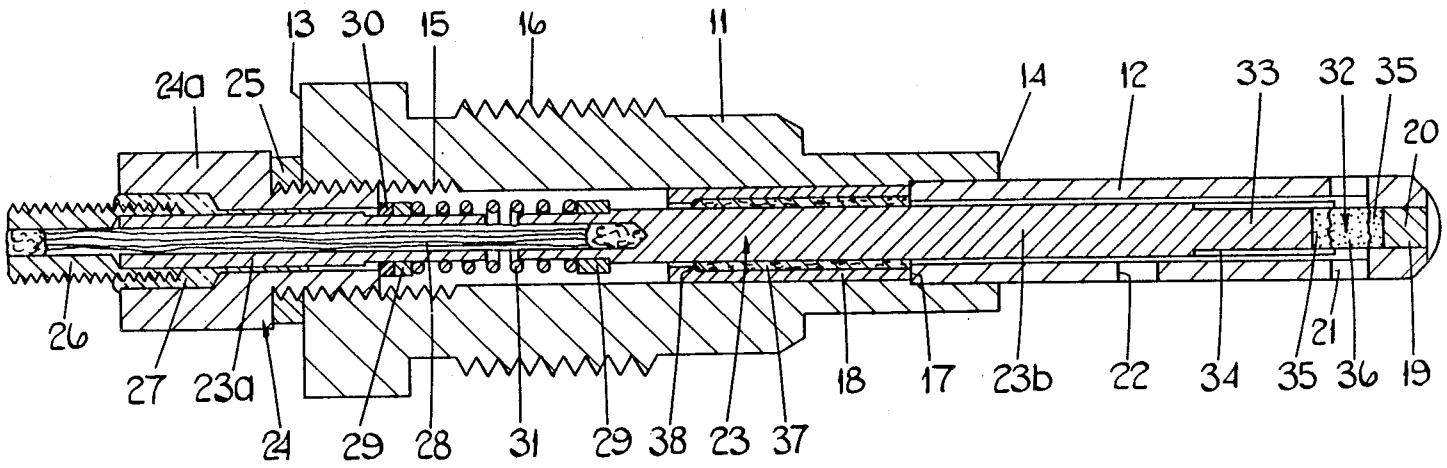
20
35
32
33
12
14
11
16
15
30
13
25
24a
26
19
36
21
35
34
22
23b
17
18
37
23
38
29
31
28
29
24
23a
27

STARTING AID FOR A COMBUSTION ENGINE

This invention relates to a starting aid for a combustion engine.

One known form of starting aid for a combustion engine is described in British Pat. No. 1,447,964 and includes a refractory electrical heating element housed within a hollow, elongated body. The heating element is trapped and compressed against one end of the body by an electrode rod through which heating current can be supplied to the heating element to raise its temperature. In addition, holes are provided in said one end of the body so that, in use, the heating element is exposed to the combustion mixture of the engine and can effect ignition of the combustion mixture. However, with this known construction the hot exhaust gases generated within the engine in use can flow through the holes in said one end of the body and along the length of the body to raise the interior of the body to a high temperature, typically between 700°–900° C., even at the end of the body remote from the heating element. In practice this is found to reduce the service life of the starting aid and an object of the present invention is therefore to minimize or alleviate this disadvantage.

Accordingly, the invention resides in one aspect in a starting aid for a combustion engine comprising a hollow, elongated body, a refractory electrical heating element mounted in the body at one end thereof, said one end of the body being formed with one or more holes through which, in use, the heating element can be exposed to the combustion mixture of an engine, an electrode rod extending through the body and electrically connected to the heating element so that, in use, heating current can be supplied to the heating element to raise its temperature, said electrode rod including two relatively movable, electrically connected parts and maintaining the heating element in compression against said one end of the body, and a heat resistant, gas restricting packing layer mounted between the body and the electrode rod intermediate the ends of the body to allow free axial movement between the electrode rod and the body and substantially prevent gas flow past the packing layer.

By preventing gas flow through the body, the packing layer enables the other end of the body to be maintained at a relatively low temperature (typically about 100° C.) when the starting aid is in use in a combustion engine and the heating element is at its elevated operating temperature (normally about 900° C.). Moreover, since the electrode rod is formed as two relatively movable parts and the packing layer permits axial movement between the electrode rod and the body, any differential thermal expansion which may occur between the electrode rod, the body and the heating element in service can be accommodated without undesirable stresses being generated in the starting aid.

Preferably, the packing layer is composed of a thermally insulating material and more preferably includes a glass fibre sleeve.

Alternatively, the packing layer is composed of a thermally conductive material and preferably includes a plurality of convolutions of aluminum foil wound around the electrode rod.

Preferably, said packing layer is trapped and deformed between the body and the electrode rod such that the packing layer has undergone radial deformation to provide the required gas restriction between the interior of the body and the electrode rod.

Conveniently, the packing layer is trapped between respective abutments defined by the body and a collar fixedly and sealingly engaging the internal surface of the body, the distance between the abutments being less than the length of the sleeve in its undeformed condition.

In a further aspect, the invention resides in a starting aid for a combustion engine comprising a hollow, elongated body, a refractory electrical heating element mounted in the body at one end thereof, said one end of the body being formed with one or more holes aligned with said heating element so that, in use, the heating element can be exposed to the combustion mixture of an engine, an electrode rod extending through the body and electrically connected to the heating element so that, in use, heating current can be supplied to the heating element to raise its temperature, said electrode rod including two relatively movable electrically connected parts and maintaining the heating element in compression against said one end of the body, said body being formed with at least one exhaust aperture spaced from said one or more holes and said heating element in the direction of the other end of the body, the exhaust aperture permitting the escape of gases entering said one end of the body through said one or more holes.

The exhaust aperture also acts to reduce the rise in temperature of the other end of the body remote from the heating element, since gases entering said one end of the body through the access holes for the heating element tend to escape through the exhaust aperture and not flow to the other end of the body. The most advantageous results are obtained when the exhaust aperture is employed in combination with the packing layer of said one aspect of the invention.

In yet a further aspect, the invention resides in a starting aid for a combustion engine comprising a hollow, elongated body, a refractory electrical heating element mounted in the body at one end thereof, said one end of the body being formed with one or more holes through which, in use, the heating element can be exposed to the combustion mixture of an engine, an electrode rod extending through the body and electrically connected to the heating element so that, in use, heating current can be supplied to the heating element to raise its temperature, said electrode rod maintaining the heating element in compression against said one end of the body, and said electrode rod including two, relatively movable parts electrically connected by a conductive braid which is capable of flexure in response to relative movement between the parts.

The use of the two-part electrode rod and the conductive braid which is capable of flexure in response to relative movement between the rod parts ensures that differential thermal expansion between the heating element and the electrode rod can be accommodated without undesirable stresses being generated in the heating element, the parts of the electrode rod and the electrical connection between the rod parts.

Preferably, the heating element includes a sintered, electrically conducting, refractory composite having a central portion of relatively high electrical resistance interposed between a pair of end terminal portions each containing a metal and having a relatively low electrical resistance.

Preferably, at least the central portion of the composite is composed of a sintered mixture of a metal and a ceramic.

Preferably, the ceramic is a metal oxide.

Preferably, the terminal portions are also composed of a sintered mixture of a metal and a ceramic, but the ratio of the amount of metal to the amount of ceramic in each terminal portion is greater than in the central portion.

Preferably, substantially planar, opposite end surfaces of the heating element are trapped between complementarily shaped surfaces of the electrode rod and the body respectively.

Preferably, said complementarily shaped surface of the body is defined by an end plug which is formed separately from, but is fixed relative to, the remainder of the body.

Preferably, a heat and oxidation resistant metal layer substantially free of entrapped air is provided between said end surfaces of the heating element and said complementarily shaped surfaces of the electrode rod and the body.

The accompanying drawing is a sectional view of a starting aid, according to one example of the present invention, for a compression ignition engine.

Referring to the drawing, the starting aid includes a hollow, stepped cylindrical electrically conductive body which is formed in two parts 11, 12. The body part 11 is open at its opposite ends 13, 14 and is formed integrally at its end 13 with an internal screw-thread 15 and an external screw-thread 16. In use, the screw-thread 16 serves to mount the starting aid within a complementarily screw-threaded bore formed in the wall of the cylinder head of a compression ignition engine. Conveniently the body part 11 is formed of mild steel.

The other body part 12 is conveniently formed from a nickel based alloy and at one open end 17 is received within, and brazed to the end 14 of the body part 11. A collar 18 received as an interference fit within the body part 11 is mounted so as to abut against the end 17 of the body part 12, the collar 18 conveniently being formed of steel, copper or aluminium. At its other end, the body part 12 is formed with an opening 19 which defines a reduced diameter extension of the body in the body part 12 and which is closed by an end plug 20 formed separately from the body part. The end plug may be welded in the opening 19 conveniently by arc welding. Moreover, in the latter case, complementary screw threads may be provided on the end plug 20 and the wall of the opening 19 respectively so that the end plug is screwed into the opening 19 prior to the arc welding operation.

The body part 12 is formed adjacent the end plug 20 with a plurality of angularly spaced holes 21 through which the interior of the body part 12 is exposed to the combustion mixture of the compression ignition engine with which the starting aid is associated in use. Further, the body part 12 is formed intermediate its ends with an exhaust aperture 22 so that, in use, gases entering the body part 12 through the holes 21 can escape by way of the exhaust aperture 22.

Extending axially through the body parts 11, 12 is an electrode rod 23 including a hollow first part **23*a* which is conveniently composed of steel and a solid second part 23*b* conveniently formed of a nickel based alloy provided with an enamel coating. The part 23*a* is surrounded along the majority of its length by a hollow, externally screw-threaded end cap 24 which is engaged with the screw thread 15 so that a headed portion 24*a* of the end cap traps a copper washer 25 against the end 13 of the body part 11. At its outermost end, the rod part 23*a* is secured to a hollow electrical connector 26 which projects from the end cap 24 and is externally screw-threaded to facilitate the provision of an external electrical connection to the electrode rod 23. The space between the end cap 24 and the connector 26 and the rod part 23*a* is filled by a solid glass seal 27. In addition the connector 26 is secured by silver solder to one end of a copper braid 28 which extends freely through the bores in the connector 26 and the rod part 23*a* and at its opposite end is joined, again by silver solder, to one end of the rod part 23*b*. The braid 28 provides a flexible, low resistance electrical connection between the rod parts 23*a*, 23*b***.

Mounted around the innermost end of the rod part **23*a* projecting from the end cap 24 are an insulating washer 30 and a metal washer 29, while a further metal washer 29 is mounted around said one end of the rod part 23*b*. Trapped by way of the washers 30, 29 between the end cap 24 and a shoulder at said one end of the rod part 23*b* is a helical compression spring 31 which urges the rod part 23*b* towards the end plug 20 so that the other end of the rod part 23*b* compresses a heating element 32 against the end plug 20. At its other end, the rod part 23*b* is stepped inwardly to define a projecting finger 33, with a sleeve 34 being mounted as an interference fit around the finger 33 and projecting therefrom to define lateral support for the heating element 32. The mating ends of the finger 33, heating element 32 and the plug 20** are machined so as to be planar and complementary, whereby satisfactory electrical connections to the heating element are ensured.

The heating element 32 is in the form of a sintered, electrically conducting, refractory composite which consists of a pair of end portions 35 and a central portion 36. The end portions 35 define the electrical contacts of the heating element and are composed of sintered chromium powder mixed with some chromium oxide powder. The central portion 36 defines the high resistance part of the heating element and is composed of sintered chromium oxide powder with chromium powder added to obtain the required electrical conductivity. The ratio of the amount of metal to the amount of oxide in each of the end portions 35 is greater than in the central portion 36. Thus, for example, each end portion 35 would typically contain 50% by volume of chromium powder and 50% by volume of chromium oxide powder, whereas the central portion 36 would contain 24% by volume of chromium powder and 76% by volume of chromium oxide powder. Conveniently, the heating element is produced by the method produced in our British Pat. No. 1,447,964 and preferably the central portion 36 is arranged to have a resistivity at room temperature between 0.01 and 10ohm cm.

As will be seen from the drawing, the heating element 32 is trapped between the finger 33 and the plug 20 so that its central portion 36 is positioned adjacent the holes 21 in the body part 12. Thus, when the starting aid is in use in a compression ignition engine, the portion 36 is exposed to the combustion mixture of the engine and hence, by supplying electric current to the heating element 32, the temperature of the portion 36 can be raised to ignite the combustion mixture. The required electric current is supplied to the heating element 32 by way of the connnector 26 and the electrode rod 23.

In order to improve the electrical contact resistance of the heating element 32 in service, a coating substantially free of entrapped air and formed of a heat and oxidation resistant high melting point metal is preferably provided over the end surfaces of the heating element. The metal coating preferably has a thickness between 0.0002 and 0.0005 inch and can be applied by any known coating technique. For example the coating may be produced by applying to the heating element a paste of fine platinum particles in a carrier liquid, such as the paste commercially available from Demetron of West Germany as Type 308A. The pasted surfaces are then heated to drive off the carrier liquid and sinter the coating, an operation which is conveniently effected by firing in air at 1000° C. Alternatively, the paste may be composed of silver particles or the metal coating may be produced by electroless nickel plating or ion plating with chromium. As a further alternative, the metal layer may be produced by introducing a powdered copper/-silver alloy of sub-micron particle size between the ends of the heating element and the end plug 20 and finger 33, tamping the powder to remove any entrapped air and then sintering the powder.

The starting aid also includes a heat resistant, gas restricting packing layer 37 which is freely mounted between the rod part 23*b* and the collar 18 substantially to prevent hot gases flowing past the exhaust aperture 22 to the end 13 of the body part 11. The packing layer 37 is preferably less hard than the enamel coating on the rod part 23*b* and may be composed of athermally insulating material such as a glass fibre sleeve (for example, the woven, resin impregnated glass fibre sleeving sold as "Red" by RS Components Ltd., of London, England), woven asbestos fibre or asbestos string. The use of an impregnated glass fibre sleeve is preferred to that of a non-impregnated version since the former has increased resistance to mechanical damage during assembly and appears to be less prone to thermal degradation in use. Alternatively, the packing layer 37 may be formed of a thermally conductive material, such as aluminium foil. In the latter case, the aluminium foil would conveniently have a thickness of 0.001 inch and 10 convolutions of the foil would be wound around the rod part 23*b* to define the packing layer. In all cases, the packing layer 37 is preferably trapped and deformed between the open end 17 of the body part 12 and an internal abutment 38 on the collar 18. The distance between the abutment 38 and the end 17 of the body part 12 is arranged to be less than the length of the packing layer, when in its undeformed condition, and hence the packing layer undergoes linear contraction and radial deformation during assembly of the starting aid. In this way, the packing layer engages the collar 18 and the rod part 23*b* so as to substantially prevent gas flow past the packing layer. In use, the heating element 32, the finger 33 and the body part 12 in the vicinity of the electrode 13 are raised to a temperature of about 900° C. but, by virtue of the exhaust aperture 22 and the packing layer 37, the region of the starting aid adjacent the braid 28 and the spring 31 remains at a relatively low temperature (typically about 100° C.). It is to be noted that the position of the exhaust aperture 22 in the body part 12 is such that, in the assembled starting aid, the aperture 22 is located intermediate the innermost end portion 35 of the heating element 32 and the packing layer 37.

In the starting aid described above, it is desirable to ensure that the braid 28 is substantially untwisted, whereas it will be appreciated that there could be a tendency for the braid to become twisted when the end cap 24 is screwed into the body part 11 to assemble the device. Thus, before assembly of the device the braid is twisted by half a turn in the opposite direction to that required to screw the end cap into the body part 11. Then, during the assembly operation, the braid 28 is not soldered to the connector 26 until the cap 24 has been screwed into the body part 11 to within half a turn of its final position trapping the washer 25 against the end 13 of the body part 11. Thereafter, when the braid has been soldered to the connector 26, the cap 24 can be screwed half a turn against the washer 25 so that the twist in the braid 28 is removed.

Conveniently, when assembling the device described above, the opening 19 is left open so that, when the electrode sub-assembly 23-31 is in position, the heating element 32 can be inserted through the opening 19 into the sleeve 34. The plug 20 can then be mounted and welded in the opening 19 so that the spring 31 is stressed and the heating element 32 is compressed between the finder 33 and the plug 20. Alternatively, the plug 20 can be mounted and welded in the opening 19 at the start of the assembly operation, with the remainder of the device then being built up onto the plug.

In a modification of the starting aid described above, the heating element 32 is metallurgically joined to the free end of the finger 33 and the end plug 20, conveniently by diffusion bonding. This is effected by locating the components in a vacuum chamber and pressing the finger 33 and plug 20 into physical and electrical contact with the end portions 35 respectively of the heating element 32. The vacuum chamber is then evacuated and current from a D.C. source is passed between the electrode rod 23 and the plug 20 through the heating element to heat the assembly. The arrangement is such that the temperature of the assembly is thereby raised to a value such that diffusion of metal occurs between the rod 23, the element 32 and the plug 20, whereby the plug 20 and rod 23 become bonded to the element 32. In one practical embodiment, satisfactory joints were obtained when a current of 10 amps was passed between the electrode rod 23 and the plug 20 for 8 minutes, the vacuum chamber being evacuated to $10^{-4}$ torr.

As a further alternative to the example described above, the opening 19 may be of the same diameter as the remainder of the bore in the body part 12 with the end plug 20 being received as an interference fit in an annular washer. The washer is in turn arranged to be an interference fit in the opening 19 and, when the plug and washer are inserted into the opening to make electrical contact with the heating element 32, the end of the body part 12 is arranged to project beyond the washer and plug. The projecting end of the washer is then swaged, crimped, rolled or welded over the plug and washer to secure the assembly in position.

We claim:

1. A starting aid for a combustion engine comprising a hollow, elongated body, a refractory electrical heating element mounted in the body at one end thereof, said one end of the body being formed with one or more holes through which, in use, the heating element can be exposed to the combustion mixture of an engine, an electrode rod extending through the body and electrically connected to the heating element so that, in use, heating current can be supplied to the heating element to raise its temperature, said electrode rod including two relatively movable, electrically connected parts and maintaining the heating element in compression against said one end of the body, and a heat resistant, gas restricting packing layer mounted between the body and the electrode rod intermediate the ends of the body to allow free axial movement between the electrode rod and the body and substantially prevent gas flow past the packing layer.

2. A starting aid as claimed in claim 1, wherein the packing layer is composed of a thermally insulating material.

3. A starting aid as claimed in claim 2, wherein the packing layer includes a glass fibre sleeve.

4. A starting aid as claimed in claim 1, wherein the packing layer is composed of a thermally conductive material.

5. A starting aid as claimed in claim 4, wherein the packing layer includes a plurality of convolutions of aluminum foil wound around the electrode rod.

6. A starting aid as claimed in claim 1, wherein said packing layer is trapped and deformed between the body and the electrode rod such that the packing layer has undergone radial deformation to provide the required gas restriction between the interior of the body and the electrode rod.

7. A starting aid as claimed in claim 6, wherein the packing layer is trapped between respective abutments defined by the body and a collar fixedly engaging the internal surface of the body, the distance between the abutments being less than the length of the sleeve in its undeformed condition.

8. A starting aid as claimed in claim 1, wherein said body is formed with at least one exhaust aperture spaced from said one or more holes and said heating element in the direction of the other end of the body, the exhaust aperture permitting the escape of gases entering said one end of the body through said one or more holes.

9. A starting aid as claimed in claim 1, wherein said parts of the electrode rod are electrically connected by a conductive braid which is capable of flexure in response to relative movement between the parts.

10. A starting aid for a combustion engine comprising a hollow, elongated body, a refractory electrical heating element mounted in the body at one end thereof, said one end of the body being formed with one or more holes aligned with said heating element so that, in use, the heating element can be exposed to the combustion mixture of an engine, an electrode rod extending through the body and electrically connected to the heating element so that, in use, heating current can be supplied to the heating element to raise its temperature, said electrode rod including two relatively movable electrically connected parts and maintaining the heating element in compression against said one end of the body, said body being formed with at least one exhaust aperture spaced from said one or more holes and said heating element in the direction of the other end of the body, the exhaust aperture permitting the escape of gases entering said one end of the body through said one or more holes.

11. A starting aid for a combustion engine comprising a hollow, elongated body, a refractory electrical heating element mounted in the body at one end thereof, said one end of the body being formed with one or more holes through which, in use, the heating element can be exposed to the combustion mixture of an engine, an electrode rod extending through the body and electrically connected to the heating element so that, in use, heating current can be supplied to the heating element to raise its temperature, said electrode rod maintaining the heating element in compression against said one end of the body, and said electrode rod including two, relatively movable parts electrically connected by a conductive braid which is capable of flexure in response to relative movement between the parts.

12. A starting aid as claimed in any one of Claims 1, 10 and 11 wherein the heating element includes a sintered, electrically conducting, refractory composite having a central portion of relatively high electrical resistance interposed between a pair of end terminal portions each containing a metal and having a relatively low electrical resistance.

13. A starting aid as claimed in claim 12, wherein at least the central portion of the composite is composed of a sintered mixture of metal and a ceramic.

14. A starting aid as claimed in claim 13, wherein the ceramic is a metal oxide.

15. A starting aid as claimed in claim 12, wherein the terminal portions are also composed of a sintered mixture of a metal and a ceramic, but the ratio of the amount of metal to the amount of ceramic in each terminal portion is greater than in the central portion.

16. A starting aid as claimed in any one of claims 1, 10 and 11 wherein substantially planar, opposite end surfaces of the heating element are trapped between complementarily shaped surfaces of the electrode rod and the body respectively.

17. A starting aid as claimed in claim 16, wherein said complementarily shaped surface of the body is defined by an end plug which is formed separately from, but is fixed relative to, the remainder of the body.

18. A starting aid as claimed in claim 16, wherein a heat and oxidation resistant metal layer substantially free of entrapped air is provided between said end surfaces of the heating element and said complementarily shaped surfaces of the electrode rod and the body.

* * * * *